United States Patent [19]

Timoney

[11] 3,958,759

[45] May 25, 1976

[54] DIRECTED ATOMIZED FUEL JET APPARATUS

[76] Inventor: Seamus Gearoid Timoney, Dublin, Ireland

[22] Filed: Jan. 2, 1975

[21] Appl. No.: 538,170

[30] Foreign Application Priority Data

Jan. 4, 1974 United Kingdom ..... 47374/74

[52] U.S. Cl. ..... 239/434

[51] Int. Cl.[2] ..... B05B 7/04

[58] Field of Search ..... 239/419, 419.3, 426, 239/434

[56] References Cited

UNITED STATES PATENTS

| | | | |
|---|---|---|---|
| 2,543,617 | 2/1951 | Wiant | 239/434 |
| 2,930,533 | 3/1960 | Maley et al. | 239/434 |
| 3,421,693 | 1/1969 | Fraser | 239/434 |
| 3,537,650 | 11/1970 | Peczeli et al. | 239/426 |
| 3,595,482 | 7/1971 | Loveday | 239/434 |
| 3,659,428 | 5/1972 | Kunioka et al. | 239/434 |
| 3,840,183 | 10/1974 | Kuribayashi | 239/434 |

*Primary Examiner*—Lloyd L. King
*Attorney, Agent, or Firm*—Alan M. Staubly

[57] ABSTRACT

A liquid atomizing nozzle for injecting atomized fuel or water or fuel and water into an internal combustion engine or into a boiler. The nozzle has at least one passage for air and one region where turbulence of air is established and at least one passage with an exit for directing liquid fuel into said region for combustion. The nozzle also may include at least one passage with an exit for directing water into said region. Where there are more than one combustion regions in said engine or boiler, there will be more than one set of passages, turbulence regions and exits, with each second exit directed into a separate combustion region or into a common manifold in the direction of a separate intake of a separate combustion region.

16 Claims, 6 Drawing Figures

DIRECTED ATOMIZED FUEL JET APPARATUS

This invention relates to liquid-atomizing nozzles, for example, for providing atomized fuel, or water, or water and fuel and one object is to provide a nozzle which is strong, simple to make, and not susceptible to damage. Such a nozzle may be used, for example, for fuel injection into the inlet manifold of a spark-ignition or a compression ignition internal-combustion engine, or for injecting atomized fuel and/or water into a boiler. British Pat. No. 1,063,860; 1,207,609; 1,210,699; 1,284,384 and U.S. Pat. No. 2,518,858 are known prior art.

According to the invention a liquid-atomizing nozzle comprises a passage for a stream of air to a region where turbulence of the air is to be established, and a passage for directing liquid into the said region for atomization in the turbulent air and a directional exit passage form the region for the atomized liquid, which passage is elongated but of restricted area so that the liquid exits as a directed jet.

Thus, the liquid can be directed exactly at a desired point, for example, at or into the inlet port of the engine. It is then not difficult to control the amount of atomized liquid supplied to each cylinder of an engine to provide the same charge to each, thereby avoiding such inequalities as might occur if the liquid were sprayed into the inlet manifold upstream of the inlet port. Also there is little chance of the liquid condensing before entry into the cylinder in a cold engine, if it is directed straight at the inlet port. In a multi-cylinder engine there would be one nozzle for each cylinder or possibly for each pair of cylinders, or more than one exit passage from each of one or more nozzles so that each cylinder could have its own jet of liquid directed appropriately. Thus, a four cylinder engine may have only one nozzle with four directed exit passages.

In that case there would be in such a multi-exit-passage nozzle a separate air passage and turbulence region for each liquid exit passage.

The, or each, incoming-liquid-directing passage and its exit passage are preferably on opposite sides of the turbulence region so that the liquid is constrained to pass across that region. They may be on a common axis transverse to the axis of the air stream passage.

Where a nozzle has a number of liquid-exit passages, there is conveniently a central axial liquid inlet surrounded by air passages, each liquid passage leading radially outwardly from the central inlet across the turbulence regions.

The turbulence region may be provided by a recess into which the stream of air is directed and from which it is reflected to interfere with the incoming air stream and set up turbulence.

According to another aspect of the invention, an internal-combustion engine is operated with a proportion of water added to the fuel; the water being preferably atomized.

It has been found that finely atomized additions of water to the combustion air in both spark-ignition and compression-ignition engines improves the fuel economy.

In the case of a compression-ignition engine, an addition of water in an amount equal to from 30 to 50% of the amount of fuel by weight can give a 5 to 10% fuel economy at the cost of providing a second tank for the water. In a spark-ignition engine an increase in economy of 10 – 20% can be obtained.

The water can be atomized in a head as defined above, if it is to be supplied separately from the fuel. However, there is much to be said for supplying the water and fuel together as an atomized mixture.

Then the atomizing head will have separate passages for directing the respective liquids into a common turbulence region, or into separate turbulence regions, from which the two atomized jets lead for subsequent mixing, either within the head or possibly outside the head. In the latter case the jets of the two atomized liquids can be directed to converge or intersect at a common point to ensure thorough mixing before meeting the combustion air.

A further aspect of the invention is the simple method of manufacture that is possible by making all the passages drilled bores of appropriate diameter.

According to that aspect of the invention, a liquid-atomizing nozzle comprises an axial bore for liquid, one or more air bores parallel with the liquid bore but spaced laterally from it, a relatively fine bore connecting the liquid bore with the, or each, air bore, and a relatively large bore leading from each region where an air bore meets a fine bore, all the bores being drilled holes. It is also possible to die cast the nozzle.

The invention may be carried into practice in various ways, and one embodiment will now be described by way of example with reference to the accompanying drawings, of which:

Figure 1:
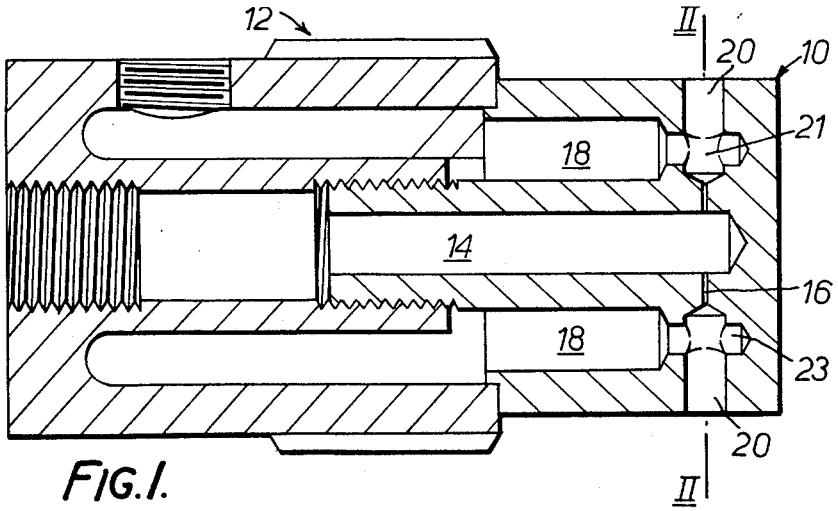
FIG. 1 is a longitudinal section through a fuel atomizing device embodying the invention.
Figure 2:
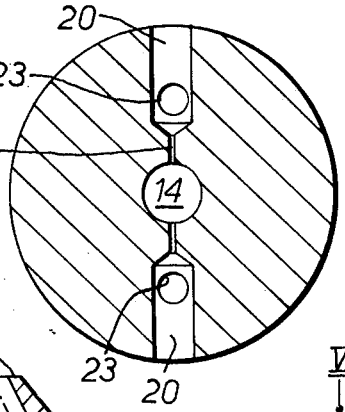
FIG. 2 is a cross-section on the line II—II in FIG. 1.

The device of FIG. 1 consists of an atomizing head 10 which is screwed into a body 12. The head has a blind axial bore 14 through which fuel can be fed from the body 12 to a point just short of the end of the head 10. The fuel then leaves the bore 14 through two small, diametrically opposite radial bores 16, each of which leads into a further bore 18 parallel to the axial bore 14. The bores 18 are enlarged at their ends closest to the body 12, and like the bore 14 stop short of the end of the head 10. Air is supplied to the bores 18 from the body 12, and both air and fuel leave the atomizing device through two radial bores 20 which are larger than, but coaxial with, the bores 16.

It will be seen from the drawing that the smaller diameter portion of each of the bores 18 extends a small distance on each side of the radial bore 20. That part of the smaller diameter part of the bore 18 nearer the body 12 forms an air nozzle, while that part further from the body forms a resonator 23.

In operation, air is supplied under pressure to the bores 18, and is formed by the air nozzles into two jets directed towards the resonators 23. As a result, a considerable flow disturbance is created in the region 21 of the radial bores 16. The fuel from the bores 16 has to cross the region 21 to reach the outlet bores 20 and in doing so, is thoroughly atomised by the turbulent air. The resulting mist leaves the device through the bores 20, and because of the restricted and parallel-sided nature of these bores, the most leaves as directed jets.

The atomizing head 10 consists of a single-piece of metal with all the passages formed by drilling. In one example, the bore 14 and the larger part of the bores 18 are 0.2 inch diameter; the smaller part of the bores 18 are 0.1 inch diameter; the radial bores 20 are 0.125 inch diameter; and the radial bores 16 are 0.01 inch diameter. It is thus very simple to make.

It is of course possible for there to be one, or more than two sets of bores 16, 18, 20 provided in a single atomizing head. One would be suitable for injecting fuel into the inlet port of a single cylinder engine.

Where the application is a spark-ignition engine in which atomized fuel is to be injected into the air inlet to the engine cylinder or cylinders, the directional direction from each bore 20 enables the fuel to be injected directly into or towards an inlet port, there being one bore 20 for each cylinder, so that a four-cylinder engine could have two heads as shown, spaced apart along the inlet manifold.

Figure 3:
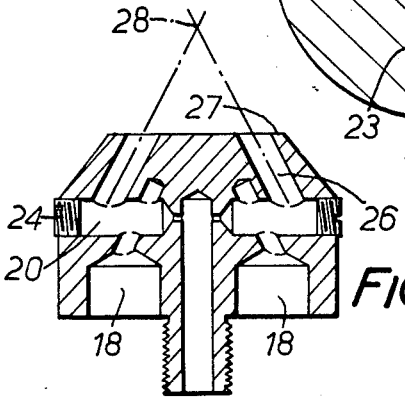
FIG. 3 is a longitudinal section of an alternative atomizing head.
Figure 4:
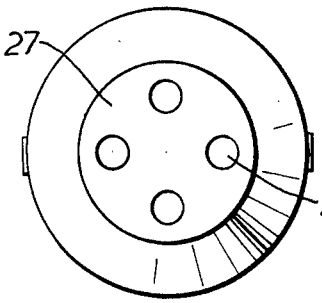
FIG. 4 is a front view of the head of FIG. 3.

FIGS. 3 and 4 show how further atomization can be achieved by causing the diverted jets from a number of the bores 20 to converge. The outer ends of the bores 20 are plugged at 24, and the fuel turned through an obtuse angle into bores 26 drilled from the front 27 of the head. The jets from all of four bores in FIGS. 3 and 4 converge at a point 28 where atomization is completed and which would be in the entrance of a cylinder port.

Figure 5:
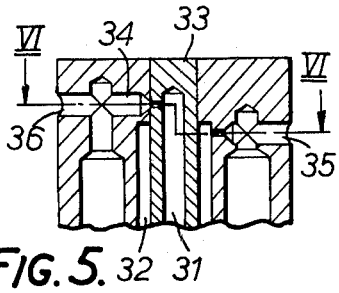
FIG. 5 is a view similar to FIG. 3 of an atomizing head suitable for atomizing two liquids.
Figure 6:
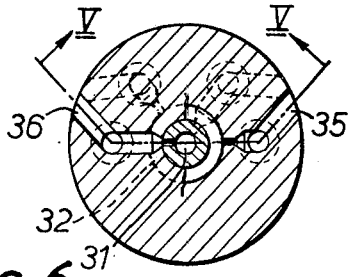
FIG. 6 is a section on the line VI—VI in FIG. 5 in a fragment of an engine.

It has been found that finely atomized additions of water to the combustion air in both spark-ignition and compression-ignition engines improves the fuel economy; the atomizer described with reference to FIGS. 5 and 6 can be used for such additions by using fuel and water respectively in different bores 18. The two liquids, fuel and water, are supplied along concentric passages 31 and 32 formed in, and around, respectively an insert 33. From each passage two jets are fed along a restricted radial bore 34 to one of a number of air resonators 35, where atomization occurs.

A directed atomized fuel jet and a directed atomized water jet meet at 36 at each side of the head to give a mixture for injection into an inlet manifold M towards an inlet port I in a cylinder C of an engine E.

Again, a head as described in FIGS. 1 and 2 or 3 and 4 could be used to add water only to either kind of engine having a separate fuel supply. Similarly addition of a small percentage of fuel through such an atomizing system in a compression-ignition engine has been found to increase the smoke-limited power output.

If the invention is applied to boiler firing, there might be a single head with five or six sets of bores, or even a number of heads, each with several sets of bores for supplying atomized fuel, the heads being possibly as shown in FIGS. 1 and 2, or 3 and 4.

I claim:

1. A liquid atomizing nozzle for an internal combustion engine comprising a first passage for a high velocity stream of air; a region designed to receive and create resonate turbulence of the air; a second passage for directing liquid into said region for atomization thereof in the turbulent air; and a third exit passage from the region for the atomized liquid, which exit passage is elongated but of restricted area so that the atomized liquid exits as a jet capable of being directed towards an inlet of a combustion chamber.

2. A nozzle as claimed in claim 1 in which said liquid-directing second passage and said third passage are on opposite sides of the turbulence region.

3. A nozzle as claimed in claim 1 in which the second passage and the third passage are co-axial.

4. A nozzle as claimed in claim 1 in which the axis of each of the second passage and of the third passage is transverse to the axis of the air stream passage.

5. A nozzle as claimed in claim 1 wherein said region includes a recess into which said stream of air is directed and from which it is reflected to interfere with the following air stream to set up turbulence.

6. A nozzle as claimed in claim 1 including passages defining a plurality of each of said passages.

7. A nozzle as claimed in claim 6 in which there is a separate air passage and turbulence region for each exit passage.

8. A nozzle as claimed in claim 6 in which pairs of third passages are arranged so that the atomized fluid jets therefrom converge or intersect at a common point.

9. A nozzle as claimed in claim 8 in which there is a central liquid inlet passage surrounded by air passages and connected to one of each pair of said third passages and in which liquid flows outwardly from the central passage across the turbulence region.

10. A liquid atomizing nozzle comprising an axial bore for liquid; at least one air bore parallel with the liquid bore and spaced laterally from it and terminating in a resonator chamber; a relatively fine bore connecting the liquid bore with the air bore; and a relatively large bore leading from where the air bore meets said fine bore, all the bores being drilled holes.

11. A liquid atomizing nozzle comprising an axial bore for one liquid; a co-axial annular bore around and spaced from the axial bore for a second liquid; a plurality of annularly spaced bores parallel to and around said annular bore; a resonator turbulence region at the outer end of each of said parallel bores; and alternate exit bores extending from said axial and co-axial bores passing through alternate turbulence regions to provide atomization of each of said liquids.

12. A liquid atomizing nozzle as claimed in claim 11 wherein said alternate exit bores are in converging pairs to provide directed jets of mixtures of said liquids.

13. A nozzle as defined in claim 12 wherein the exit bores from the axial bore are axially beyond the exit bores from said co-axial bore.

14. An internal combustion engine having a nozzle as defined in claim 6 with exit passages arranged so that the atomized fuel jets issuing therefrom are directed into the engine's inlet manifold and each towards an inlet port in separate cylinders.

15. An engine as claimed in claim 14 in which water is atomized through half of said second passages and fuel is atomized through the other half.

16. An engine as claimed in claim 15 wherein the liquid flow is controlled to provide water in the amount of between 30% and 50% of the amount of fuel by weight.

* * * * *